US008047164B2

(12) United States Patent
Hughes

(10) Patent No.: US 8,047,164 B2
(45) Date of Patent: Nov. 1, 2011

(54) REMOVABLE HEAT EXCHANGER FOR A GAS FIRED WATER HEATER

(75) Inventor: Dennis R. Hughes, Hartford, WI (US)

(73) Assignee: AOS Holding Company, Wilmington, DE (US)

( * ) Notice: Subject to any disclaimer, the term of this patent is extended or adjusted under 35 U.S.C. 154(b) by 690 days.

(21) Appl. No.: 12/138,131

(22) Filed: Jun. 12, 2008

(65) Prior Publication Data

US 2009/0308333 A1 Dec. 17, 2009

(51) Int. Cl.
*F24H 1/08* (2006.01)

(52) U.S. Cl. ..... 122/18.3; 122/18.31; 165/70

(58) Field of Classification Search ..... 122/18.1, 122/18.2, 18.3, 18.31, 33; 165/53, 56, 70, 165/71, DIG. 348, DIG. 350
See application file for complete search history.

(56) References Cited

U.S. PATENT DOCUMENTS

| | | | | | |
|---|---|---|---|---|---|
| 1,059,685 | A | | 4/1913 | Oberste | |
| 1,991,980 | A | | 2/1935 | Hetzer | |
| 2,046,569 | A | | 7/1936 | Madorin | |
| 2,143,287 | A | | 1/1939 | Smith | |
| 2,587,720 | A | | 3/1952 | Fritzberg | |
| 2,602,644 | A | | 7/1952 | Sandstrom | |
| 2,660,996 | A | | 12/1953 | Wasp et al. | |
| 3,238,928 | A | | 3/1966 | Phillips | |
| 3,823,704 | A | | 7/1974 | Daugirda et al. | |
| 4,143,816 | A | | 3/1979 | Skadeland | |
| 4,465,024 | A | * | 8/1984 | Adams | 122/17.2 |
| 4,545,329 | A | * | 10/1985 | Adams | 122/17.2 |
| 4,651,714 | A | * | 3/1987 | Granberg | 122/18.3 |
| 4,790,268 | A | | 12/1988 | Eising | |
| 4,884,963 | A | * | 12/1989 | Kardos | 431/1 |
| 4,938,204 | A | * | 7/1990 | Adams | 122/18.2 |
| 4,960,078 | A | * | 10/1990 | Yokoyama et al. | 122/24 |
| 4,989,670 | A | | 2/1991 | Foley | |
| 5,044,928 | A | * | 9/1991 | Yokoyama et al. | 431/1 |
| 5,044,930 | A | * | 9/1991 | Hongo et al. | 431/1 |
| 5,145,354 | A | * | 9/1992 | Palm, Jr. | 431/1 |
| 5,207,212 | A | * | 5/1993 | Woollen, Jr. | 122/18.3 |
| 5,253,703 | A | | 10/1993 | Master et al. | |
| 5,313,914 | A | * | 5/1994 | Woollen | 122/136 R |
| 5,437,249 | A | * | 8/1995 | Adams et al. | 122/18.3 |

(Continued)

OTHER PUBLICATIONS

PVI Industries, LLC, Turbopower Gas Packaged Water Heater Tank Series 125 Gallons Catalog Sheet available at http://www.pvi.com/pdf%20files/5610.pdf at least as early as Jan. 2004.

(Continued)

*Primary Examiner* — Gregory A Wilson
(74) *Attorney, Agent, or Firm* — Michael Best & Friedrich LLP

(57) ABSTRACT

A water heater. The water heater includes a water tank having a tank wall defining an interior space and adapted to contain water to be heated, a tank extension having an extension wall detachably mounted to the tank wall, the extension wall defining extension space communicating with the interior space, and defining an extension axis, an air inlet at least partially in the extension space extending through the extension wall at a radial angle to extension axis of tank extension, a combustor at least partially in the extension space and in fluid communication with the air inlet, and a plurality of heat exchange tubes configured to receive products of combustion from combustor and extending into interior space of the water tank. The extension space is configured to be flooded with water from the water tank.

20 Claims, 3 Drawing Sheets

U.S. PATENT DOCUMENTS

| | | | | |
|---|---|---|---|---|
| 5,666,943 | A | 9/1997 | Adams | |
| 5,666,944 | A * | 9/1997 | Ferguson | 122/18.3 |
| 6,161,506 | A * | 12/2000 | Hanson | 122/18.3 |
| 6,210,149 | B1 | 4/2001 | Plavnik et al. | |
| 6,957,629 | B1 | 10/2005 | Steinhafel et al. | |
| 2003/0192684 | A1 * | 10/2003 | Roberts et al. | 165/163 |

OTHER PUBLICATIONS

PVI Industries, LLC, Turbopower Gas Packaged Water Heater Standard and Optional Equipment List available at http://www.pvi.com/pdf%20files/6000.pdf at least as early as Jan. 2004.

* cited by examiner

REMOVABLE HEAT EXCHANGER FOR A GAS FIRED WATER HEATER

BACKGROUND

The present invention relates to water heaters, and more particularly to removable heat exchangers for gas fired water heaters.

SUMMARY

In one embodiment, the invention provides a water heater. The water heater includes a water tank having a tank wall defining an interior space and adapted to contain water to be heated, a tank extension having an extension wall detachably mounted to the tank wall, the extension wall defining an extension space communicating with the interior space, and defining an extension axis, an air inlet at least partially in the extension space extending through the extension wall at a radial angle to the extension axis of the tank extension, a combustor at least partially in the extension space and in fluid communication with the air inlet, and a plurality of heat exchange tubes configured to receive products of combustion from the combustor and extending into the interior space of the water tank. The extension space is configured to be flooded with water from the water tank.

In another embodiment, the invention provides a water heater. The water heater includes a water tank having a tank wall defining an interior space and adapted to contain water to be heated and a tank extension having an extension wall detachably mounted to the tank wall, the extension wall defining an extension space communicating with the interior space, and defining an extension axis. The tank extension includes an air inlet at least partially in the extension space extending through the extension wall in a direction substantially perpendicular to the extension axis of the tank extension, a combustor at least partially in the extension space and in fluid communication with the air inlet, an igniter configured to provide ignition within the combustor, the igniter operatively coupled to the combustor and extending through the tank extension, a fuel nozzle configured to control the amount of fuel entering the combustor, the fuel nozzle operatively coupled to the combustor and extending through the tank extension, and a plurality of heat exchange tubes configured to receive products of combustion from the combustor, the plurality of heat exchange tubes positioned in the tank extension and extending into the water tank. The extension space provides additional space for water from the interior space of the water tank to flood the extension space.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention is intended for use with a gas fired water heater. The concept of a removable heat exchanger may be applied to non-gas fired water heaters as well. The present invention should therefore not necessarily be limited to gas fired water heaters, although the illustrated embodiments include a gas fired water heater application. Furthermore, the removable heat exchanger is described for use with a pulse combustion system that creates pressure pulses. However, the removable heat exchanger may be utilized with other types of combustion technologies, including, but not limited to, premix combustion technology.

Figure 1:
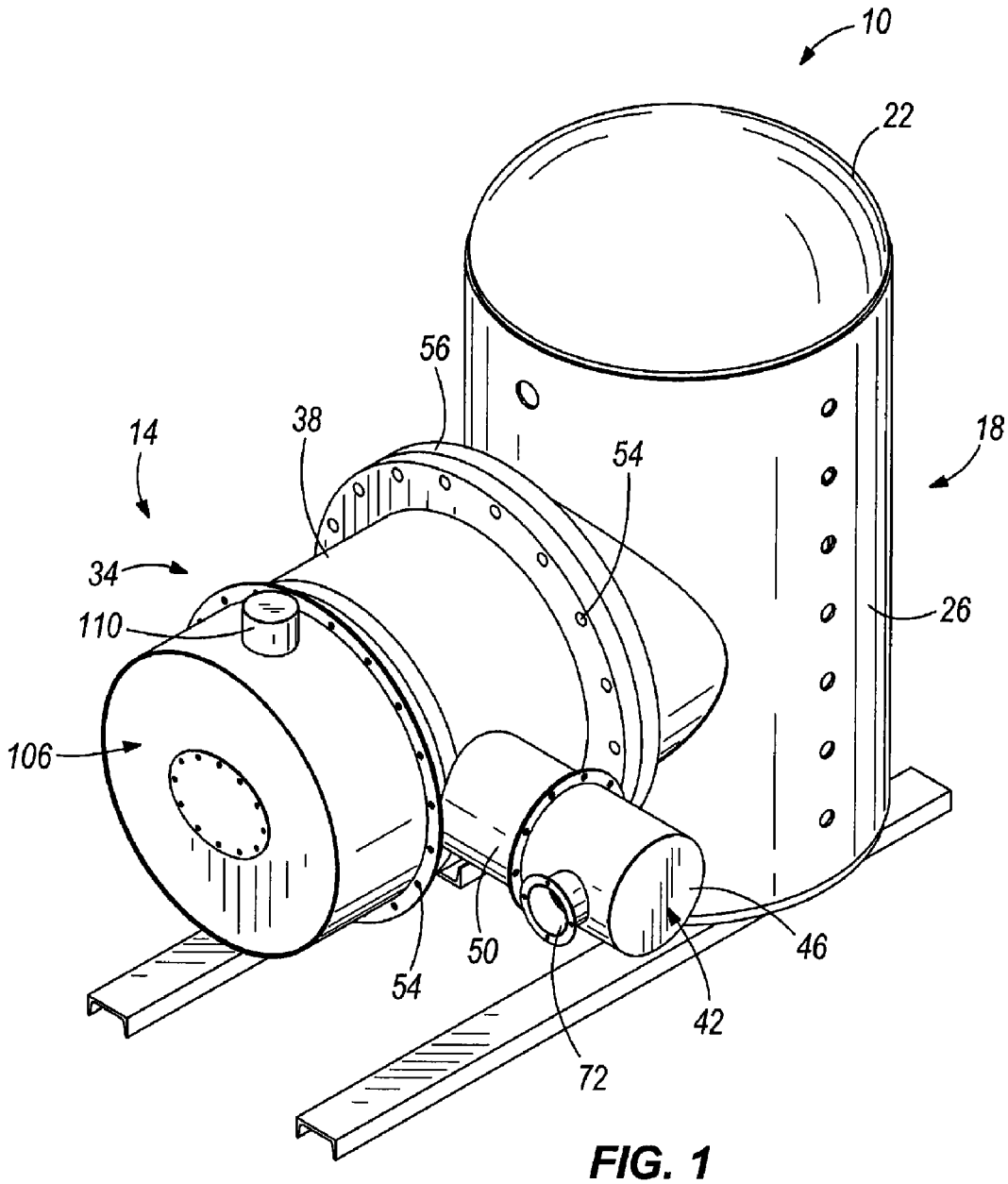
FIG. 1 illustrates a water heater according to the invention.
Figure 2:
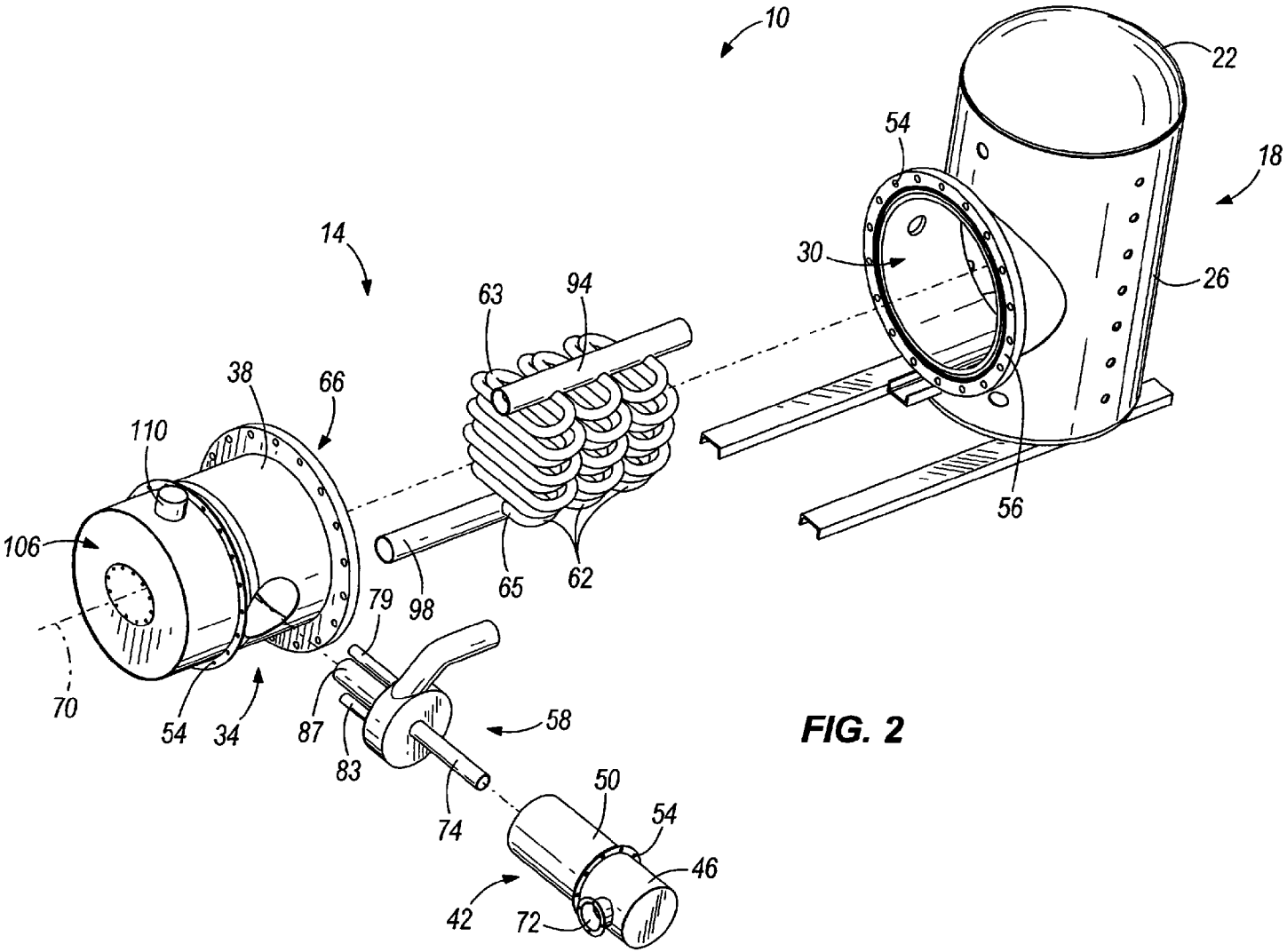
FIG. 2 is an exploded view of the water heater of FIG. 1.
Figure 3:
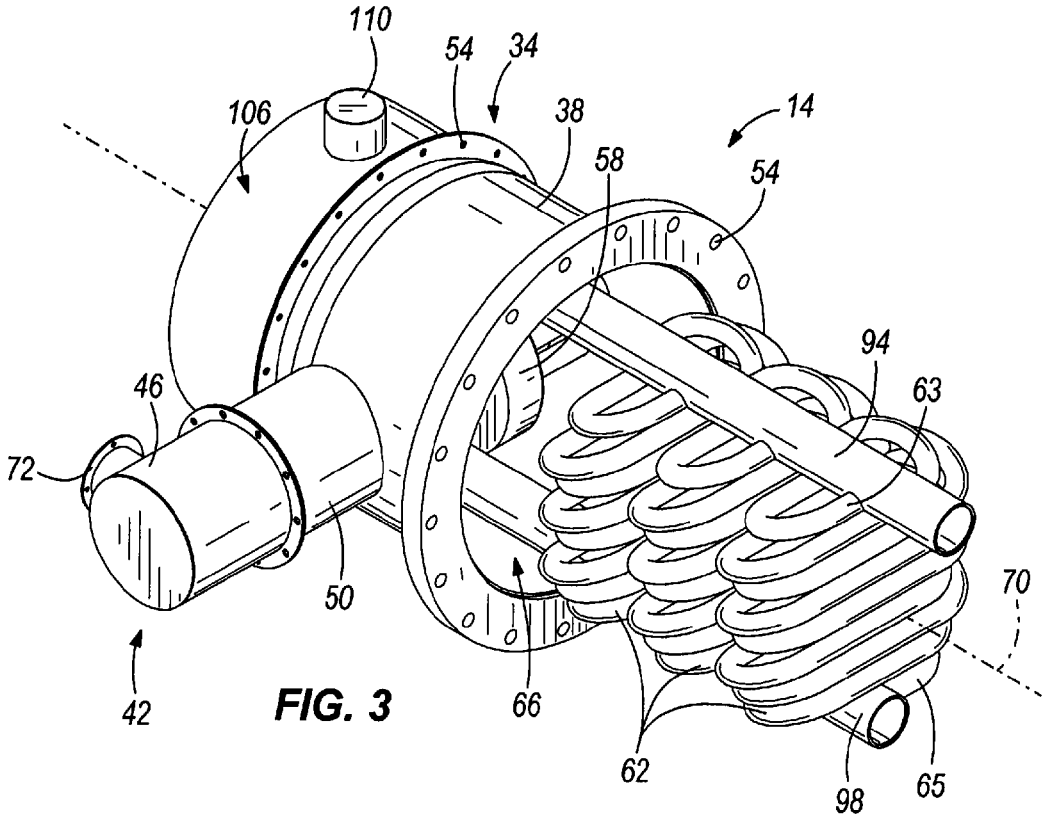
FIG. 3 is a perspective view of a tank extension and removable heat exchanger of the water heater.
Figure 4:
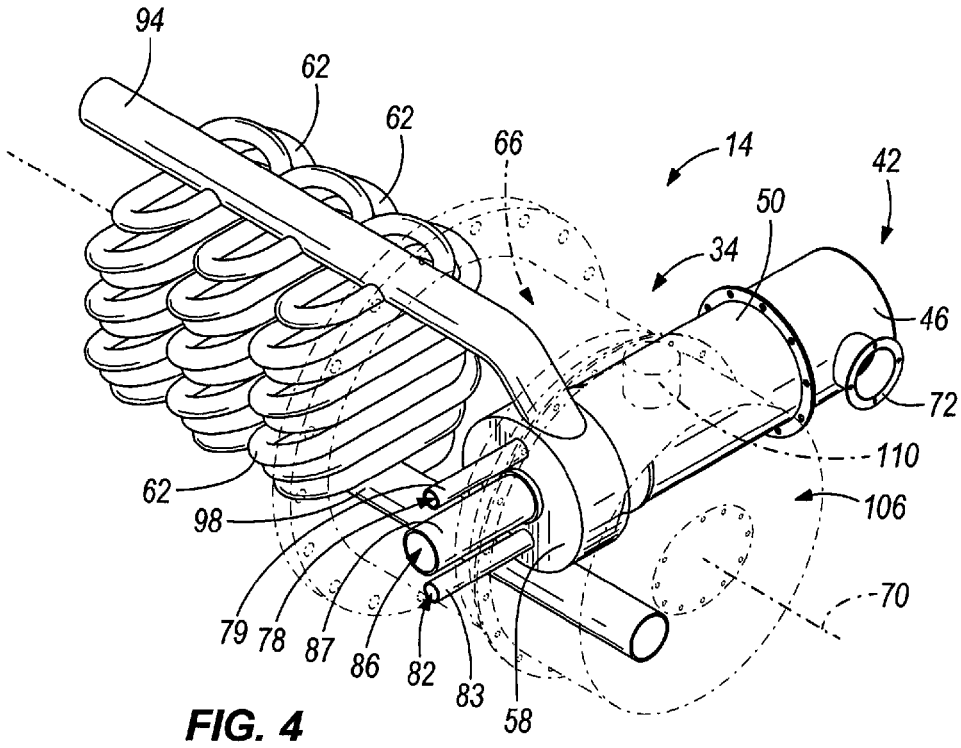
FIG. 4 is a rear perspective of the removable heat exchanger shown in FIG. 3 with the tank extension in phantom.

FIGS. 1 and 2 illustrate a water heater 10 and removable heat exchanger 14 embodying the present invention. The water heater 10 includes a generally cylindrical tank 18 having a dome-shaped upper head 22. The cylindrical water tank 18 is preferably formed of corrosion resistant material, such as glass coated steel. The water tank 18 has a tank wall 26 defining an interior space 30. The water heater 10 further includes a detachably mounted tank extension 34 having an extension wall 38, an air chamber 42, a combustor 58 and a plurality of heat exchange tubes 62. The water tank 18 is adapted to contain water to be heated. The tank extension 34 includes the extension wall 38 and is detachably mounted to the tank wall 26 with fasteners 54 at a tank wall mount 56. The extension wall 38 defines an extension space 66 (see FIGS. 3-4) that is configured to communicate with the interior space 30 of the water tank 18. The tank extension 34 further defines an extension axis 70. The extension axis 70 extends along a longitudinal length of the tank extension 34.

The air chamber 42 is at least partially disposed in the extension space 66 and extends through the extension wall 38 in a direction substantially perpendicular to the extension axis 70 of the tank extension 34. The air chamber 42 may extend through the extension wall 38 at any radial angle, and preferably extends substantially perpendicular to the extension axis 70 of the tank extension 34 to minimize the portion of the air chamber 42 within the extension space 66. Extending the air chamber 42 through the extension wall 38 provides more space in the extension space 66 for the heat exchange tubes 62 when compared to containing the entire air chamber 42 within the tank extension 34. This may provide more space for additional tubes 62 and heat exchange surfaces. The air chamber 42 includes an upper chamber or decoupler 46, and a lower chamber 50. The air decoupler 46 is part of the pulse combustor system. The air decoupler 46 communicates with the combustor and decouples air in the decoupler from the pressure pulses in order to control the pressure pulses of the pulse combustor system. The upper and lower chambers 46, 50 are coupled together with a plurality of fasteners 54. An air inlet 72 is positioned adjacent the air chamber 42 and outside of the extension space 66 in fluid communication with the atmosphere for air intake. The air chamber 42 and air inlet 72 facilitate air intake for combustion. An air tube 74 having a smaller diameter than the diameter of the air decoupler 46 extends through the air chamber 42 and further controls the amount of air intake for the combustor 58.

The combustor 58 of the water heater 10 is at least partially disposed in the extension space 66 and in fluid communication with the air chamber 42 to receive air from the air inlet 72. The air tube 74 is coupled to the combustor 58 to deliver intake air to the combustor 58. The combustor is illustrated as a pulse combustor; however, in other embodiments, other combustors and combustion systems can be used. The plurality of heat exchange tubes 62 receives the products of combustion from the combustor 58. The plurality of heat exchange tubes 62 extend into the interior space 30 of the water tank 18. The heat exchange tubes 62 are bundled in pairs to provide efficient heat exchange in the condensed space of the water tank 18. The heat exchange tubes are designed in bundles with sufficient pitch to allow for intertwining of the heat exchange tubes. The bundling of the heat exchange tubes provides that the tubes are offset, which allows each of the heat exchange tubes to be accessible for routine cleaning and maintenance, such as for example, but not limited to, accessing a cleaning port of a heat exchange tube for cleaning.

The water heater 10 further includes an igniter 78, a flame sensor 82, and a fuel nozzle 86. The igniter 78 is operatively coupled to the combustor 58 and substantially positioned within a tube 79 that extends through the extension wall 38. The igniter 78, including but not limited to a spark plug, is configured to provide ignition to the fuel-air mixture in the combustor 58. The flame sensor 82 is operatively coupled to the combustor 58 and substantially positioned within a tube 83 that extends through the extension wall 38. The flame sensor 82 is configured to sense flame in the combustor 58 and control operation of the combustor 58. The fuel nozzle 86 is also operatively coupled to the combustor 58 and substantially positioned within a tube 87 that extends through the extension wall 38. The fuel nozzle 86 is configured to control the amount of fuel, such as including, but not limited to natural gas or propane gas, entering the combustor 58. The positioning of each of the igniter, flame sensor and fuel nozzle through the extension wall provides that the igniter, flame sensor, and fuel nozzle are accessible for any adjustments or maintenance.

Each of the plurality of heat exchange tubes 62 communicates at a first end 63 with a combustion manifold 94 and at a second, opposite end 65 with an exhaust manifold 98. The combustion manifold 94 is coupled to the combustor 58 and extends into the interior space 30 of the water tank 18. The combustion manifold 94 is configured to receive the products of combustion from the combustor 58 and further configured to couple to each of the plurality of heat exchange tubes 62 at the first end 63. The combustion manifold 94 distributes the products of combustion to each of the plurality of heat exchange tubes 62 that tap into the combustion manifold 94. The exhaust manifold 98 is configured to couple to each of the plurality of heat exchange tubes 62 at the second, opposite end 65 and extends into the interior space 30 of the water tank 18.

The water heater 10 further includes an exhaust decoupler 106. The exhaust decoupler 106 is positioned adjacent the tank extension 34 and coupled to the tank extension 34 with fasteners 54. The exhaust decoupler 106 is configured to receive the products of combustion from the combustor 58 and further configured to control pulsation of the pulse combustor system, including, but not limited to, decoupling the products of combustion from the pressure pulses. An exhaust gas outlet 110 extends from the exhaust decoupler 106 and provides an outlet for exhaust gas, while condensate drainage exits the exhaust decoupler 106 through a drain aperture separate from the exhaust outlet.

The tank extension 34 is detachably coupled to the water tank 18 at the tank wall mount 56. The tank extension 34 is configured to be flooded with water from the interior space 30 of the water tank 18. The tank extension 34 provides additional space to accommodate the combustor 58 and the plurality of heat exchange tubes 62 of the water heater 10. Accordingly, the heat exchange capacity of the water heater is greater than the heat exchange capacity of a water heater without the flooded tank extension because the flooded tank extension provides for more space for heat exchange. In further embodiments, the tank extension is extendible to accommodate additional heat exchange tubes for increased heat exchange with water surrounding the heat exchange tubes. The tank extension can extend from other areas of the water tank as long as the water heater and combustion system can still effectively and efficiently operate. In other embodiments, the tank extension 34 may include an access door configured to provide access between the exhaust decoupler 106 and the extension space 66.

In operation, air delivered by the air chamber 42 and air tube 74 is mixed in the combustor 58 with fuel provided by the fuel nozzle 86. The fuel is ignited and the products of combustion exit the combustor 58 through the combustion manifold 94. The combustion manifold 94 distributes the products of combustion to each of the plurality of heat exchange tubes 62 coupled to the combustion manifold 94. The products of combustion proceed down each of the plurality of heat exchange tubes 62 to maximize the surface area for heat exchange. Any condensate drainage flows toward the exhaust manifold 98. The exhaust manifold 98 delivers the exhaust gas and condensate drainage to the exhaust decoupler 106. The exhaust gas exits the water heater 10 through the exhaust outlet 110, while the condensate drainage exits the exhaust decoupler 106 through a drain aperture separate from the exhaust outlet.

The length of the air chamber and the size of the air decoupler is determined by the requirements of the pulse combustion system and water heater application. Furthermore, the tank extension, combustor, and plurality of heat exchange tubes can be of various sizes to accommodate different heating capacities and applications.

Various features and advantages of the invention are set forth in the following claims.

What is claimed is:

1. A water heater comprising:

a water tank having a tank wall defining an interior space and adapted to contain water to be heated;

a tank extension having an extension wall detachably mounted to the tank wall, the extension wall defining an extension space communicating with the interior space, and defining an extension axis;

an air inlet at least partially in the extension space extending through the extension wall at a radial angle to the extension axis of the tank extension;

a combustor at least partially in the extension space and in fluid communication with the air inlet; and a plurality of heat exchange tubes configured to receive products of combustion from the combustor and extending into the interior space of the water tank;

wherein the extension space is configured to be flooded with water from the water tank.

2. The water heater of claim 1, further comprising an igniter configured to provide ignition within the combustor, the igniter operatively coupled to the combustor and extending through the extension wall.

3. The water heater of claim 1, further comprising a flame sensor configured to sense flame in the combustor, the flame sensor operatively coupled to the combustor and extending through the extension wall.

4. The water heater of claim 1, further comprising a fuel nozzle configured to control the amount of fuel entering the combustor, the fuel nozzle operatively coupled to the combustor and extending through the extension wall.

5. The water heater of claim 1, wherein the combustor is a pulse combustor creating pressure pulses.

6. The water heater of claim 5, further comprising an air chamber communicating between the air inlet and the combustor.

7. The water heater of claim 5, further comprising an air decoupler communicating with the combustor and decoupling air in the decoupler from the pressure pulses.

8. The water heater of claim 5, further comprising an exhaust decoupler receiving products of combustion from the combustor and decoupling the products of combustion in the exhaust decoupler from the pressure pulses.

9. The water heater of claim 1, further comprising a combustion manifold coupled to the combustor and extending into the interior space of the water tank, the combustion manifold configured to couple to each of the plurality of heat exchange tubes.

10. The water heater of claim 9, further comprising an exhaust manifold extending into the interior space of the water tank, the exhaust manifold configured to couple to each of the plurality of heat exchange tubes.

11. The water heater of claim 1, wherein the tank extension is extendible to accommodate additional heat exchange tubes.

12. A water heater comprising:

a water tank having a tank wall defining an interior space and adapted to contain water to be heated; and a tank extension having an extension wall detachably mounted to the tank wall, the extension wall defining an extension space communicating with the interior space, and defining an extension axis, the tank extension comprising:

an air inlet at least partially in the extension space extending through the extension wall in a direction substantially perpendicular to the extension axis of the tank extension;

a combustor at least partially in the extension space and in fluid communication with the air inlet;

an igniter configured to provide ignition within the combustor, the igniter operatively coupled to the combustor and extending through the tank extension;

a fuel nozzle configured to control the amount of fuel entering the combustor, the fuel nozzle operatively coupled to the combustor and extending through the tank extension; and a plurality of heat exchange tubes configured to receive products of combustion from the combustor, the plurality of heat exchange tubes positioned in the tank extension and extending into the water tank;

wherein the extension space provides additional space for water from the interior space of the water tank to flood the extension space.

13. The water heater of claim 12, wherein the combustor is a pulse combustor creating pressure pulses.

14. The water heater of claim 13, further comprising an air chamber communicating between the air inlet and the combustor.

15. The water heater of claim 13, further comprising an air decoupler communicating with the combustor and decoupling air in the decoupler from the pressure pulses.

16. The water heater of claim 13, further comprising an exhaust decoupler receiving products of combustion from the combustor and decoupling the products of combustion in the exhaust decoupler from the pressure pulses.

17. The water heater of claim 12, further comprising a combustion manifold coupled to the combustor and extending into the water tank, the combustion manifold configured to couple to each of the plurality of heat exchange tubes.

18. The water heater of claim 17, further comprising an exhaust manifold extending into the water tank, the exhaust manifold configured to couple to each of the plurality of heat exchange tubes.

19. The water heater of claim 12, further comprising a flame sensor configured to sense flame in the combustor, the flame sensor operatively coupled to the combustor and extending through the extension wall.

20. The water heater of claim 12, wherein the tank extension is extendible to accommodate additional heat exchange tubes.

* * * * *